US008077550B2

(12) United States Patent
Akiyama

(10) Patent No.: US 8,077,550 B2
(45) Date of Patent: Dec. 13, 2011

(54) ELECTRONIC TIMEPIECE, TIME ADJUSTMENT METHOD FOR AN ELECTRONIC TIMEPIECE, AND CONTROL PROGRAM FOR AN ELECTRONIC TIMEPIECE

(75) Inventor: Toshikazu Akiyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 585 days.

(21) Appl. No.: 12/323,115

(22) Filed: Nov. 25, 2008

(65) Prior Publication Data

US 2009/0135675 A1 May 28, 2009

(30) Foreign Application Priority Data

Nov. 27, 2007 (JP) ..... 2007-305815

(51) Int. Cl.
*G04B 19/22* (2006.01)
*G04C 11/02* (2006.01)

(52) U.S. Cl. ..... 368/21; 368/47

(58) Field of Classification Search ..... 368/10, 368/21, 46, 47
See application file for complete search history.

(56) References Cited

U.S. PATENT DOCUMENTS 4,884,254 A 11/1989 Kawai et al.
5,724,316 A * 3/1998 Brunts ..... 368/10
6,047,236 A * 4/2000 Hancock et al. ..... 701/208
6,278,660 B1 * 8/2001 Tognazzini ..... 368/21
6,304,212 B1 10/2001 Aoki et al.
6,950,662 B2 * 9/2005 Kumar ..... 455/456.3
2008/0031095 A1 * 2/2008 Matsuzaki et al. ..... 368/14

FOREIGN PATENT DOCUMENTS

DE 10 2005 021 002 A1 11/2006
EP 0 498 199 A2 8/1992
EP 1 014 235 A2 6/2000
JP 08-068848 3/1996
JP 11-183594 7/1999
JP 2003-139875 5/2003
WO 2006/117059 A2 11/2006

* cited by examiner

*Primary Examiner* — Vit Miska

(57) ABSTRACT

An electronic timepiece has a reception unit that can receive satellite signals transmitted from positioning information satellites and acquire time information and positioning information; a time zone data storage component that stores region data dividing geographical information for which time zone information is set into a plurality of regions, and time zone information for each region; a time zone information acquisition component that extracts a region containing positioning information acquired by the reception unit from the region data, and acquires the time zone information for that region; a time zone information display that displays the time zone information acquired by the time zone information acquisition component as a time zone candidate; an input device; a time zone information selection component that selects time zone information from the time zone candidates displayed on the display based on operation of the input device; a time calculation component that calculates the current time based on the time information acquired by the reception unit and the time zone information selected by the time zone information selection component; and a time display that displays the current time.

9 Claims, 13 Drawing Sheets

350 351 352 353

| INDEX | TOP LEFT COORDINATE (LONGITUDE, LATITUDE) | BOTTOM RIGHT COORDINATE (LONGITUDE, LATITUDE) | TIME ZONE TABLE INDEX | PREVIOUSLY SELECTED TIME ZONE |
|---|---|---|---|---|
| 1 | E108, N49 | E124, N21 | 17 | – |
| 2 | E124, N39 | E146, N31 | 18, 19 | 19 |
| 3 | E93, N21 | E108, N6 | 15, 16 | – |
| . . . | . . . | . . . | . . . | . . . |

35

361 362 363

36

| TIME ZONE TABLE INDEX | TIME DIFFERENCE TO UTC | CITY NAME |
|---|---|---|
| 1 | 0 | |
| 2 | 0 | LONDON |
| 3 | 1 | PARIS |
| 4 | 1 | BERLIN |
| 5 | 2 | ATHENS |
| 6 | 2 | CAIRO |
| 7 | 3 | MOSCOW |
| 8 | 3 | BAGHDAD |
| 9 | 3.5 | TEHRAN |
| 10 | 4 | DUBAI |
| 11 | 4.5 | KABUL |
| 12 | 5 | KARACHI |
| 13 | 5.5 | DELHI |
| 14 | 6 | DHAKA |
| 15 | 6.5 | YANGON |
| 16 | 7 | BANGKOK |
| 17 | 8 | HONG KONG |
| 18 | 9 | SEOUL |
| 19 | 9 | TOKYO |
| 20 | 9.5 | ADELAIDE |
| 21 | 10 | SYDNEY |
| 22 | 11 | NOUMEA |
| 23 | 12 | WELLINGTON |
| 24 | -10 | HONOLULU |
| ・・・ | ・・・ | ・・・ |

FIG. 4

ELECTRONIC TIMEPIECE, TIME ADJUSTMENT METHOD FOR AN ELECTRONIC TIMEPIECE, AND CONTROL PROGRAM FOR AN ELECTRONIC TIMEPIECE

CROSS-REFERENCE TO RELATED APPLICATIONS

Japanese Patent application No. 2007-305815 is hereby incorporated by reference in its entirety.

BACKGROUND

1. Field of Invention

The present invention relates to an electronic timepiece, a time adjustment method for an electronic timepiece, and a control program for an electronic timepiece that receives radio signals transmitted from positioning satellites such as GPS satellites and acquires the current date and time.

2. Description of Related Art

The Global Positioning System (GPS) for determining the position of a GPS receiver uses GPS satellites that circle the Earth on known orbits, and each GPS satellite has an atomic clock on board. Each GPS satellite therefore keeps the time (referred to below as the GPS time or satellite time information) with extremely high precision.

All GPS satellites transmit the same GPS time, and the Universal Coordinated Time (UTC) is acquired by adding the UTC offset (currently +14 seconds) to the GPS time. For an electronic timepiece to receive the satellite signal transmitted from a GPS satellite, acquire the GPS time, and display the local time (regional time) at the location where the electronic timepiece is being used, the time difference to the UTC must be added after correcting for the UTC offset in order to get the current local time, and the electronic timepiece must therefore know what this time difference is.

The UTC offset can be acquired from the data in the received satellite signal, or a predetermined value stored in ROM.

Japanese Unexamined Patent Appl. Pub. JP-A-H11-183594 is directed to a GPS device that gets the time difference information from location information after the user of the electronic timepiece selects the current location.

This GPS device stores information about selected major locations (such as country, city, or region name) around the world, including the time zone, latitude, longitude, and the geographic coordinate system, in memory. The user selects the location closest to the user's current location to set these parameters, which are then used by the GPS device to calculate and display the time at the current location based on the received GPS time.

Japanese Unexamined Patent Appl. Pub. JP-A-H08-68848 is directed to a GPS navigation system that acquires positioning information using satellite signals transmitted from the GPS satellites, and automatically calculates the time difference at the current location from the positioning information.

This system has a storage device that stores border information for converting the positioning data to time zone data.

Japanese Unexamined Patent Appl. Pub. JP-A-2003-139875 is directed to a radio-controlled timepiece that has a fixed-point data storage means that stores multiple fixed point data records containing fixed position information, fixed time difference information, and fixed range information, and automatically corrects the GPS time by acquiring the mobile device position using satellite signals from the GPS satellites, getting the fixed position information nearest the mobile device position, and using the fixed time difference for the fixed position as the time difference for the mobile device.

Problems with the related art described above are described below.

A problem with the GPS device in JP-A-H11-183594 is that because the list of selectable city names is displayed as a fixed list, selecting the current location can be difficult for the user depending on the location.

For example, if the city names are arranged in order of the time zone starting from Honolulu, where the time difference to UTC is −10 hours, Sydney, Australia and Wellington, NZ will be displayed as locations farthest from Honolulu. This requires the user to move the selection cursor a long distance from Honolulu, and making a selection is thus laborious.

The GPS navigation system in JP-A-H08-68848 automatically acquires the time difference based on the current location identified using the positioning signals and the previously stored border location data, and is thus convenient because it eliminates the need for the user to select the location as required with the GPS device in JP-A-H11-183594.

However, border data for all time zones around the world must be stored in the storage means to prevent detecting the wrong time difference. However, the borders between time zones are often winding national borders, and storing data for such complex borders requires a large storage capacity. As a result, size and cost constraints limit the data storage capacity in a wristwatch or other small portable device, and thus prevent being able to store such complex border data. JP-A-H11-183594 is therefore limited in the devices in which it can be used, and cannot be used in small devices such as wristwatches.

Addressing the large data storage requirement of JP-A-H11-183594, JP-A-2003-139875 provides a radio-controlled timepiece that only needs to store fixed point data for selected major cities around the world, and thus reduces the amount of data to be stored and the required storage capacity.

However, because the technology taught in JP-A-2003-139875 extracts the fixed position information closest to the mobile device position by selecting a circular area centered on a particular fixed position and uses the time difference for that fixed position if the position of the mobile device is in range of the selected fixed position, the possibility of selecting the wrong fixed position and therefore the wrong time zone (time difference) is high in areas where the time zone borders overlap.

In order to adjust the size of these circular areas, distances are normalized using a weighting coefficient referred to as the fixed range information. However, when the time zone borders overlap and there are multiple fixed positions around and near the location of the mobile device, it is difficult to set the fixed ranges so that detection errors do not occur, and the amount of data that must be stored increases.

Furthermore, because the distance between the mobile device and each fixed position must be calculated, computation time increases when there are multiple fixed positions in the vicinity of the mobile device, the time difference cannot be set quickly, and convenience is thus impaired.

SUMMARY OF INVENTION

An electronic timepiece, a time adjustment method for an electronic timepiece, and a control program for an electronic timepiece according to the present invention enable reducing the required memory capacity, use in a wristwatch, and improving user convenience.

An electronic timepiece according to a first aspect of the invention has a reception unit that can receive satellite signals transmitted from positioning information satellites and acquire time information and positioning information; a time zone data storage component that stores region data dividing geographical information for which time zone information is set into a plurality of regions, and time zone information for each region; a time zone information acquisition component that extracts a region containing positioning information acquired by the reception unit from the region data, and acquires the time zone information for that region; a time zone information display that displays the time zone information acquired by the time zone information acquisition component as a time zone candidate; an input device; a time zone information selection component that selects time zone information from the time zone candidates displayed on the display based on operation of the input device; a time calculation component that calculates the current time based on the time information acquired by the reception unit and the time zone information selected by the time zone information selection component; and a time display that displays the current time.

The electronic timepiece of the invention receives satellite signals and acquires positioning information from positioning information satellites by means of the reception unit. The time zone information acquisition component extracts the region containing the received positioning information and acquires the time zone information for that region from the region data and time zone information stored in the time zone data storage componet. The time zone information display then displays the acquired time zone information as time zone candidates for selection by the user.

As a result, the user can select the appropriate time zone from the time zone candidates selected based on the current location. This reduces the number of candidates to select from compared with selecting from a list of all possible time zone candidates, thereby enables easily selecting the appropriate time zone, and thus improves user convenience.

Furthermore, because predetermined regions are set and the time zones included in each region are stored instead of storing boundary data for each time zone region, the amount of data to be stored can be greatly reduced compared with storing border data. The invention can thus be used even in devices that do not have enough memory to store time zone border data. The invention can therefore be used in small electronic devices such as wristwatches.

In addition, because the user makes the final time zone selection, the correct time zone can be set more easily than is possible with methods that automatically set the time zone of a fixed point that is closest to the position of the mobile device.

Furthermore, when the time zone is set based on the distance between a fixed point and the position of the mobile device, the time zone is determined using region circles centered on predetermined fixed points. The possibility of time zone detection errors is therefore higher in regions where time zones and time zone boundaries overlap. In addition, when time zone borders are corrected using fixed range information, it is difficult to set the fixed range information to prevent detection errors in areas where the time zone boundaries overlap, and the amount of data to be stored increases.

The regions set by the present invention are subdivisions of geographical areas, however, and do not need to conform to the time zone borders. The amount of data to be stored can therefore be reduced and whether the mobile device is located in a particular region can be easily determined. In addition, because the user selects a time zone from a group of time zone candidates based on the detected region, the user can reliably set the time difference for the desired city (time zone), and the amount of data to be stored can be reduced.

Preferably, each region in the region data is sized so that each region contains less than or equal to a predetermined number of time zones.

By suppressing the number of time zone candidates to less than or equal to a predetermined number, the user can select the correct time zone more easily than when many time zone candidates are displayed. Furthermore, because the size of each region in the region data can be controlled so that each region contains the predetermined number of time zones or less, the size of each region can vary according to the set number of time zones in each region. Compared with all regions being the same fixed size, the invention can thus appropriately suppress the number of regions and therefore the amount of data.

If the size of a region is set to a size containing more than the predetermined number of time zones, the number of time zone candidates to be displayed by the time zone information display increases. As a result, it may not be possible to display all time zone candidates at once, thus requiring the user to scroll through a list, for example, increasing the number of operations needed to move the cursor to the desired time zone candidate, and generally complicating time zone selection.

However, by sizing the regions so that each region contains less than or equal to a predetermined number of time zones, all time zone candidates can be displayed on the time zone information display at one time, cursor movement is reduced, and operability is improved.

This predetermined number of time zones may be set appropriately according to the display size of the time zone information display. This number is normally in the range 1 to 10, and is more preferably from 1 to 5. Reducing the number of time zones reduces the number of selections and makes selection easier. However, if the number is too small, the region size also decreases and the number of regions increases, and the amount of data to store may also increase. This set number of time zones is therefore preferably set with consideration for ease of selection and the amount of data.

Yet further preferably, each region in the region data is a rectangular region.

By defining each region as a rectangle, this aspect of the invention can identify each region using only the coordinates for two diagonally opposite corners of each rectangle. The amount of data needed to store the regions can therefore be reduced.

Furthermore, because the size of each region can be set as needed, regions can be appropriately sized in parts of the world where the time zones are large, such as in North America and South America, the number of regions to be stored in the region data can be reduced accordingly, and the amount of stored data can also be further reduced.

Furthermore, because the regions are rectangular, the process of determining which region contains the acquired positioning information is extremely simple.

The regions are preferably defined by longitude and latitude lines. This configuration makes determining the region in which the positioning information (which are longitude and latitude coordinates) is located even easier when the positioning information is acquired from a satellite signal.

The electronic timepiece according to another aspect of the invention preferably also has a time zone information selection storage component that stores the time zone information selected by the time zone information selection component, and the time zone information display displays the previously selected time zone as the first time zone candidate when a previously selected time zone is stored in the time zone information selection storage component for the region containing the positioning information received by the reception unit.

Because the time zone information display displays the previously selected time zone as the first candidate, the time zone selection process is made even easier when selecting the same time zone as the previous selection. More specifically, the time zone commonly changes when travelling from one's home country to a foreign country, and the same time zone is reset when returning home. Because the same time zone is the first candidate time zone in this situation, this aspect of the invention enables the user to easily select the desired time zone and thus improves user convenience.

The electronic timepiece according to another aspect of the invention preferably also has a digital display device for displaying information. In this aspect of the invention the time zone information display displays the time zone candidates acquired by the time zone information acquisition component on the digital display device, and the time zone information selection component selects a time zone candidate displayed on the digital display device based on operation of the input device.

By using a digital display device this aspect of the invention can display the time zone (time difference) information using names such as country names and city names instead of only numerically. As a result, even if the user does not know the actual time difference from UTC, the user usually knows the name of a city, for example, in the desired time zone and can therefore easily select the correct time zone (time difference).

Yet further preferably, the time zone information display displays the time zone candidate acquired by the time zone information acquisition mcomponent first on the digital display device, and can display other time zone candidates following the time zone information.

By displaying time zone information relevant to the current location first, this aspect of the invention enables easily selecting the local time zone while also enabling selecting other time zones. This enables setting the time to the local time at the destination before travelling to a foreign country, for example, and thus further improves user convenience.

The electronic timepiece according to another aspect of the invention also has an analog display device including a hand and a dial with markings indicating time zone candidates. The time zone information display moves the hand at a regular time interval to sequentially point to markings indicating time zone candidates acquired by the time zone information acquisition component; and the time zone information selection component selects the time zone candidate indicated by the hand when the input device is operated.

This aspect of the invention enables selecting time zone candidates by means of an analog hand, and thereby enables easily selecting time zone information even in analog timepieces that do not have a digital display device.

Another aspect of the invention is a time adjustment method comprising a time zone data storage step of storing region data dividing geographical information for which time zone information is set into a plurality of regions, and time zone information for each region; a reception step of receiving satellite signals transmitted from positioning information satellites and acquiring time information and positioning information; a time zone information acquisition step that extracts a region containing positioning information acquired by the reception step from the region data, and acquires the time zone information for that region; a time zone information display step that displays the time zone information acquired by the time zone information acquisition step as a time zone candidate; a time zone information selection step that selects time zone information from the displayed time zone candidates based on operation of an input device; a time calculation step that calculates the current time based on the time information acquired by the reception step and the time zone information selected by the time zone information selection step; and a time display step that displays the current time.

Yet another aspect of the invention is a control program for an electronic timepiece having a reception unit that can receive satellite signals transmitted from positioning information satellites and acquire time information and positioning information, a control device, a storage device that stores region data dividing geographical information for which time zone information is set into a plurality of regions, and time zone information for each region, an input device, and a display device. The control program causes the control device to extract a region containing positioning information acquired by the reception unit from the region data and acquire the time zone information for that region; display the acquired time zone information as a time zone candidate; select time zone information from the displayed time zone candidates based on operation of the input device; calculate the current time based on the acquired time information acquired and the selected time zone information; and a time display that displays the current time.

These aspects of the invention have the same effect as the electronic timepiece of the invention described herein. More specifically, the different aspects of the invention reduce the required memory capacity, and can therefore be used even in wristwatches, while improving user convenience and enabling setting the correct time zone.

BRIEF DESCRIPTION OF THE DRAWINGS

FIG. 4 shows an example of a time zone data table.

DESCRIPTION OF THE PREFERRED EMBODIMENTS

Preferred embodiments of the present invention are described below with reference to the accompanying figures.

The embodiments described below are specific preferred embodiments of the present invention and certain technically preferred limitations are therefore also described, but the scope of the present invention is not limited to these embodiments or limitations unless specifically stated below.

Embodiment 1

Figure 1:
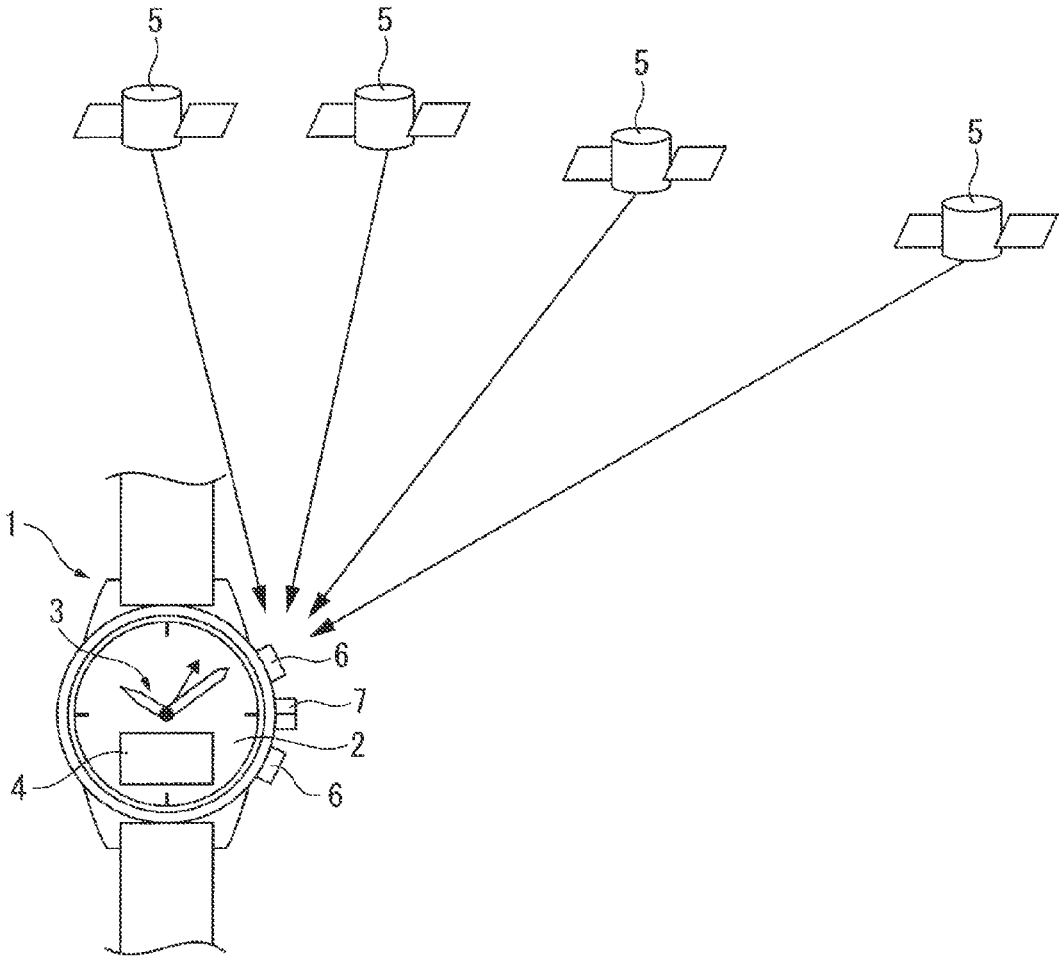
FIG. 1 is a schematic diagram showing a GPS wristwatch according to the present invention.
Figures 2, 3:
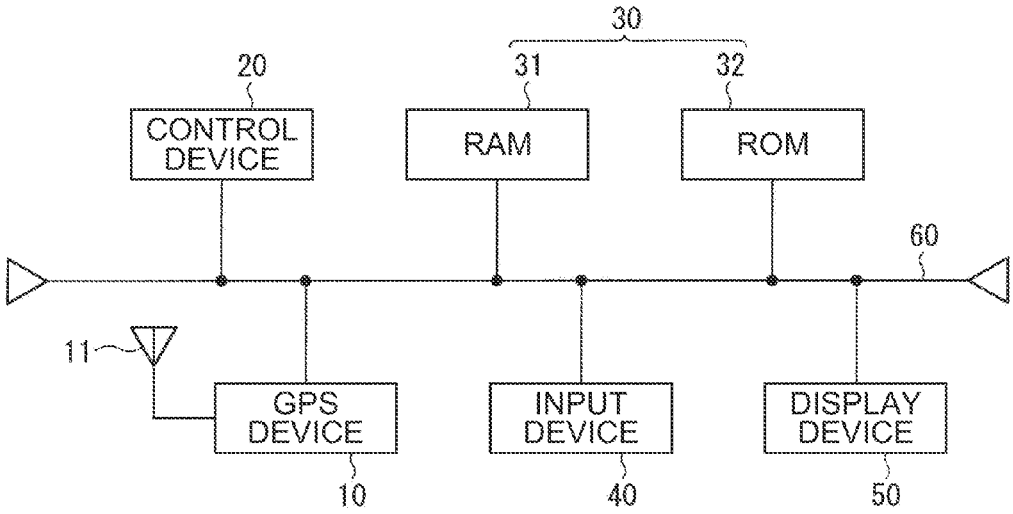
FIG. 2 is a schematically shows the circuit configuration of the GPS wristwatch.
FIG. 3 shows an example of a region data table.

FIG. 1 is a schematic diagram showing a wristwatch with a GPS satellite signal reception device 1 (referred to below as a GPS wristwatch 1) as an example of an electronic timepiece according to the present invention. FIG. 2 shows the main hardware configuration of the GPS wristwatch 1.

As shown in FIG. 1, the GPS wristwatch 1 has a time display unit including a dial 2 and hands 3. A window is formed in a part of the dial 2, and a display 4 (digital display device) such as an LCD panel is located in this window. The GPS wristwatch 1 is thus a combination timepiece having both hands 3 and a display 4.

The hands 3 include a second hand, minute hand, and hour hand, and are driven through a wheel train by a stepping motor.

The display 4 is typically a LCD unit and is used for displaying the current time and messages in addition to city names as time zone candidates as further described below.

The GPS wristwatch 1 receives satellite signals from a plurality of GPS satellites 5 orbiting the Earth on fixed orbits in space and acquires satellite time information to adjust the internally kept time and positioning information, that is, the current location, on the display 4.

The GPS satellite 5 is an example of a positioning information satellite in the invention, and a plurality of GPS satellites 5 are orbiting the Earth in space. At present there are approximately 30 GPS satellites 5 in orbit.

The GPS wristwatch 1 has a crown 7 and buttons 6 as input devices (external operating members).

Circuit Design of the GPS Wristwatch

As shown in FIG. 2, the GPS wristwatch 1 has a GPS device 10 (GPS module), a control device 20 (CPU), a storage device 30, an input device 40, and a display device 50. The storage device 30 includes RAM 31 and ROM 32. Data is communicated between these different devices over a data bus 60.

The display device 50 includes hands 3 and a display 4 for displaying the time and positioning information.

The GPS wristwatch 1 has an internal battery as the power source. The battery may be a primary battery or a rechargeable storage battery.

GPS Device

The GPS device 10 has a GPS antenna 11 and acquires time information and positioning information by processing satellite signals received through the GPS antenna 11.

The GPS antenna 11 is a patch antenna for receiving satellite signals from a plurality of GPS satellites 5 orbiting the Earth on fixed orbits in space. The GPS antenna 11 is located on the back side of the dial 12, and receives RF signals through the crystal and the dial 2 of the GPS wristwatch 1.

The dial 2 and crystal are therefore made from materials that pass RF signals, particularly the satellite signals transmitted from the GPS satellites 5. The dial 2, for example is plastic.

Although not shown in the figures, the GPS device 10 includes an RF (radio frequency) unit that receives and converts satellite signals transmitted from the GPS satellites 5 to digital signals, a baseband unit that correlates the reception signal and synchronizes with the satellite, and a data acquisition unit that acquires the time information and positioning information from the navigation message (satellite signal) demodulated by the baseband unit.

The RF unit includes bandpass filter, a PLL circuit, an IF filter, a VCO (voltage controlled oscillator), an A/D converter, a mixer, a low noise amplifier, and an IF amplifier.

The satellite signal extracted by the bandpass filter is amplified by the low noise amplifier, mixed by the mixer with the signal from the VCO, and down-converted to an IF (intermediate frequency) signal. The IF signal mixed by the mixer passes the IF amplifier and IF filter, and is converted to a digital signal by the A/D converter.

The baseband unit includes a local code generator and a correlation unit. The local code generator generates a local C/A code (also referred to as a "local code" herein) that is identical to the C/A code used for transmission by the GPS satellite 5. The correlation unit calculates the correlation between this local code and the reception signal output from the RF unit.

If the correlation calculated by the correlation unit is greater than or equal to a predetermined threshold value, the local code and the C/A code used in the received satellite signal match, and the satellite signal can be captured (that is, the receiver can synchronize with the satellite signal). The navigation message can thus be demodulated by applying this correlation process to the received satellite signal using the local code.

The data acquisition unit gets the time information and positioning information from the navigation message demodulated by the baseband unit. More specifically, the navigation message transmitted from the GPS satellites 5 contains subframe data such as a preamble and the TOW (Time of Week, also called the Z count) carried in a HOW (handover) word. The subframe data is divided into five subframes, subframe 1 to subframe 5, and the subframe data includes the week number, satellite correction data including the satellite health, the ephemeris (detailed orbital information for the particular GPS satellite 5), and the almanac (approximate orbit information for all GPS satellites 5 in the constellation).

The data acquisition unit extracts a specific part of the data from the received navigation message, and acquires the time information and positioning information. The GPS device 10 thus renders a reception unit and reception device in this embodiment of the invention.

A program that is run by the control device 20 is stored in ROM 32 in the storage device 30.

The region data table 35 shown in FIG. 3 and the time zone data table 36 shown in FIG. 4 are stored in RAM 31 in the storage device 30. As further described below, there are also areas for storing the time information and positioning information acquired by receiving the satellite signal.

As shown in FIG. 3, the region data table 35 stores an index 350 for each region, region data 351 describing divisions of geographical areas for which time zone values are set, a time zone table index 352 containing the index numbers of the time zones contained in each region, and the previously selected time zone 353 storing the time zone table index of the previously selected time zone.

Figure 5:
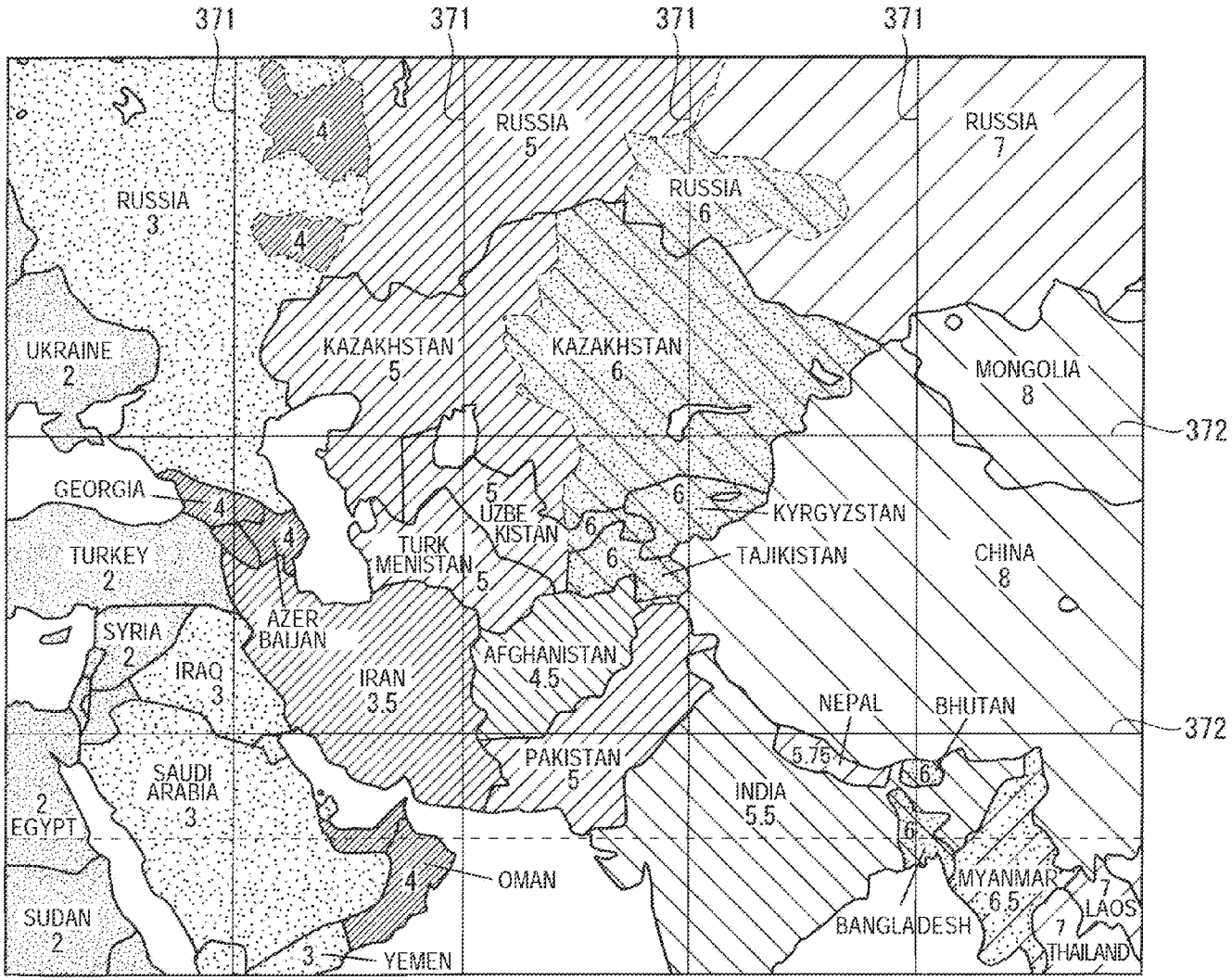
FIG. 5 shows an example of geographical information for which time zone data is set.

As shown in FIG. 5, the regions in this embodiment of the invention are rectangular areas enclosed by two longitude lines 371 and two latitude lines 372. The region data 351 therefore stores the longitude and latitude coordinates of the top left corner and the longitude and latitude coordinates of the bottom right corner of each area. Because these are rectangular areas, each area can be identified using only the coordinates of two points.

Each area is also sized to contain less than or equal to a predetermined number of time zones. This predetermined number (also referred to as the setting) is 6 in this embodiment of the invention, and each area is sized to contain from 1 to 6 time zones. These regions cannot be set very large in the area of Central Asia shown in FIG. 5, for example, because the time zones overlap in complicated ways. Regions in this part of Central Asia are therefore set with a width and length of 15 degrees longitude and latitude. In North America and South America, however, the time zones are relatively large and larger regions can therefore be used.

The time zone table index 352 stores the index numbers of the time zones contained in each rectangular area set in the region data 351.

The previously selected time zone 353 records the number of the time zone table index indicating the time zone previously selected for that region.

The time zone data table 36 contains multiple records each containing a time zone table index 361, the time difference to UTC 362, and the name of a major city 363 in that time difference 362 (time zone).

For example, a time difference of 0 hours to UTC and a city name of LONDON are stored in the time zone referenced by time zone table index 2.

Figure 6:
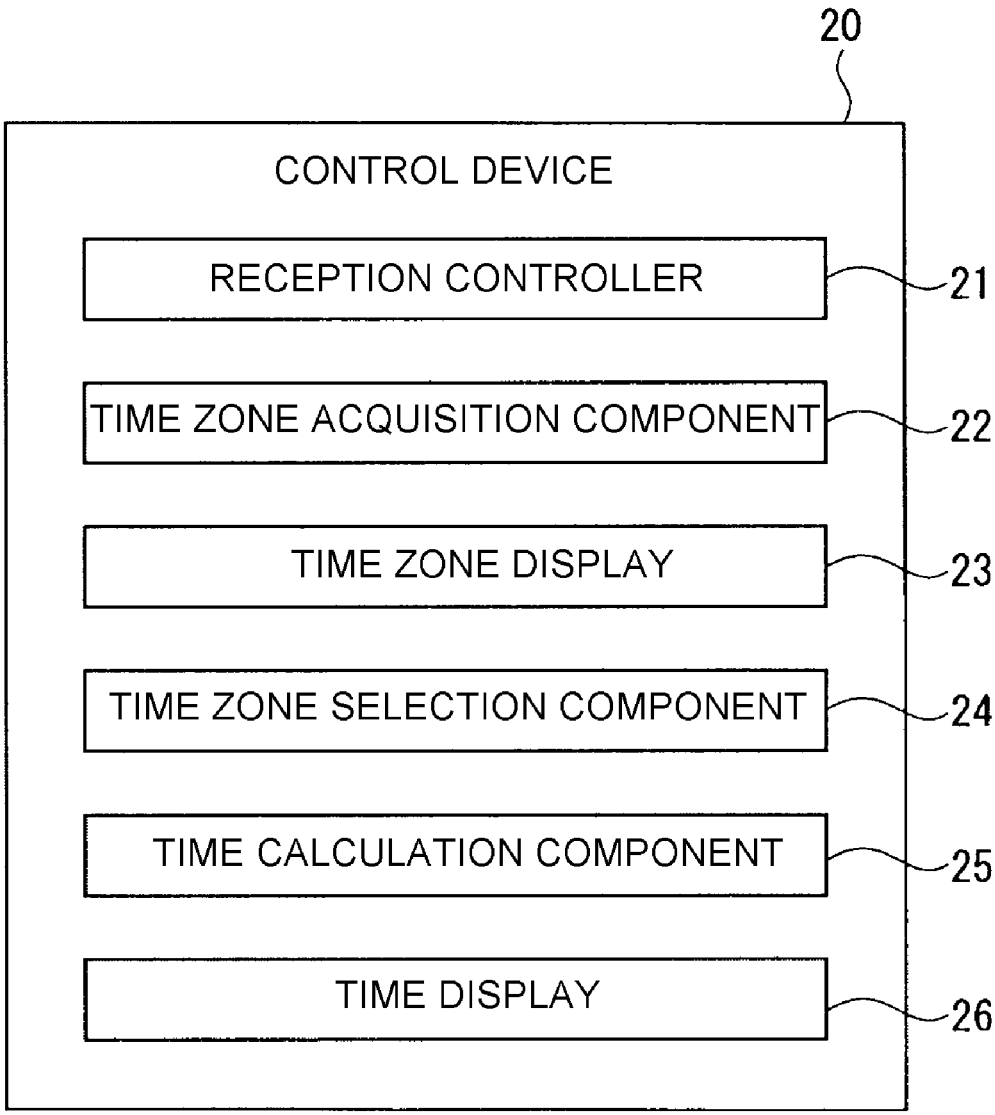
FIG. 6 is a block diagram showing the configuration of the control device.

The control device 20 (CPU) controls operation by running a program stored in ROM 32. As shown in FIG. 6, the control device 20 therefore includes a reception controller 21, a time zone acquisition component 22, a time zone display component 23, a time zone selection component 24, a time calculation component 25, and a time display 26.

When the reception controller 21 detects a signal from the input device 40 indicating that reception has been triggered by a button 6, the crown 7, or other input device 40, the reception controller 21 drives the GPS device 10 to execute the satellite signal reception process.

The time zone acquisition component 22 then compares the current location information (longitude and latitude) acquired by the GPS device 10 with the region coordinates stored in the region data 351 of the region data table 35 to find the corresponding region.

If a region containing the current location information is found, the time zone acquisition component 22 searches the time zone table index 361 of the time zone data table 36 for the time zone table index number(s) stored in the time zone table index 352 field of the region data table 35 for the identified region, and gets the time difference to UTC 362 and the major city name 363 identified by the time zone table index 361.

The time zone display 23 then displays the time difference to UTC 362, or more specifically the major city name 363 at that time difference to UTC 362, acquired by the time zone acquisition component 22 as a time zone candidate on the display 4.

The time zone selection component 24 then selects a major city name 363 from the time zone candidate list displayed on the display 4 based on operation of the button 6, crown 7, or other input device 40.

The time calculation component 25 then calculates the current time at the current location (the local time) based on the time information acquired by the GPS device 10 (the GPS time+UTC offset) and the time difference to UTC 362 (time zone) of the city name 363 selected by the time zone selection component 24.

The time display 26 normally displays the internal time, which is kept based on a reference signal output from an oscillation circuit, using the hands 3. The time display 26 can also digitally display the internal time on the display 4.

When the local time has been calculated by the time calculation component 25, the internal time is adjusted and displayed according to the calculated local time. The corrected internal time is thereafter updated according to the reference signal.

The display device 50 is rendered by the hands 3 and display 4, and is controlled by the control device 20 as described above.

The hands 3 are driven by a stepping motor and wheel train, and indicate the internally kept time, which is adjusted based on the received time data. The display 4 displays information such as the time and positioning information, and displays a list of candidate time zones from which a time zone is selected.

Time Information Reception Process

The reception operation of the GPS wristwatch 1 is described next with reference to the flow chart in FIG. 7.

Figure 7:
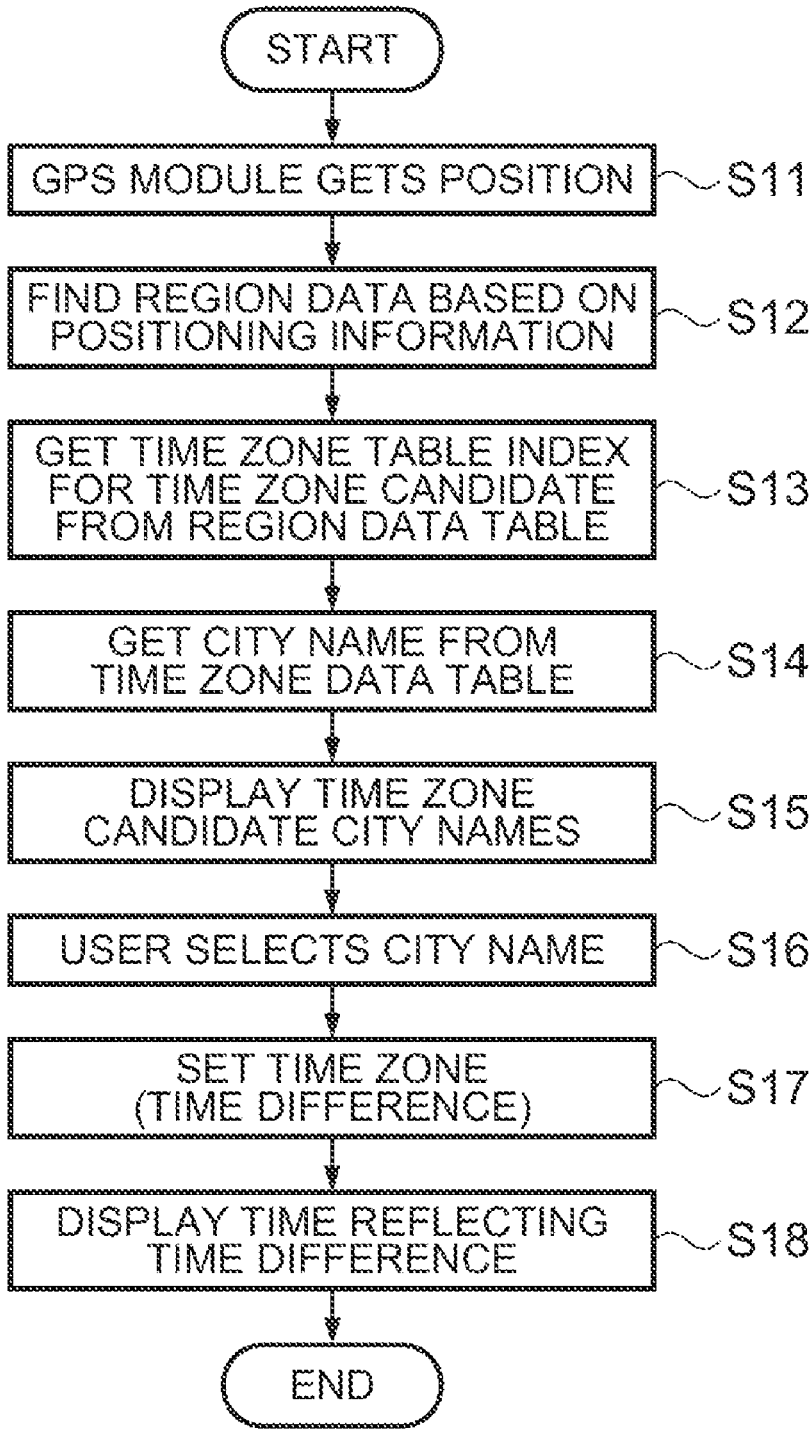
FIG. 7 is a flow chart describing the reception process in the first embodiment of the invention.

The reception process shown in FIG. 7 is run when the user initiates reception. More specifically, in order to acquire the positioning information for positioning, ephemeris data containing detailed orbit information for the GPS satellites 5 must be received from four satellites. Acquiring the ephemeris for four GPS satellites 5 requires approximately 60 seconds, and power consumption therefore rises accordingly. As a result, the reception process is preferably executed when correcting the time displayed by the GPS wristwatch 1, such as when it is necessary for the user to receive the positioning information after travelling to a different country or returning home from a foreign country.

When reception starts the reception controller 21 of the control device 20 drives the GPS device 10 (GPS module) to get the positioning information (S11). The time information is also acquired in S11 because the time information is acquired simultaneously to acquiring the positioning information.

The time zone acquisition component 22 then searches the region data table 35 based on the acquired positioning information, and detects the region in which the positioning information (coordinate data) is located (S12).

For example, if the current location is near Narita Airport and the acquired positioning information is 140°23'6 east longitude and 35°45'51" north latitude, the positioning information corresponding to an east longitude range of E124-E146 and north latitude range of N31-N39 can be retrieved from the index 2 record in the region data table 35. The time zone acquisition component 22 thus detects that region corresponding to the acquired positioning information is the region identified by index 2.

The time zone acquisition component 22 then finds the detected region in the region data table 35, or more specifically finds index 2 in the region data table 35 and reads the numbers in the time zone table index 352 field for that region (S13). Using the region data table 35 shown in FIG. 3, the time zone acquisition component 22 thus acquires the time zone candidate indices 18 and 19 that are stored for region index 2.

The time zone acquisition component 22 then looks up the city names for the acquired time zone candidate indices 18 and 19 in the time zone data table 36, and gets the city names Seoul and Tokyo (S14).

Figure 8:
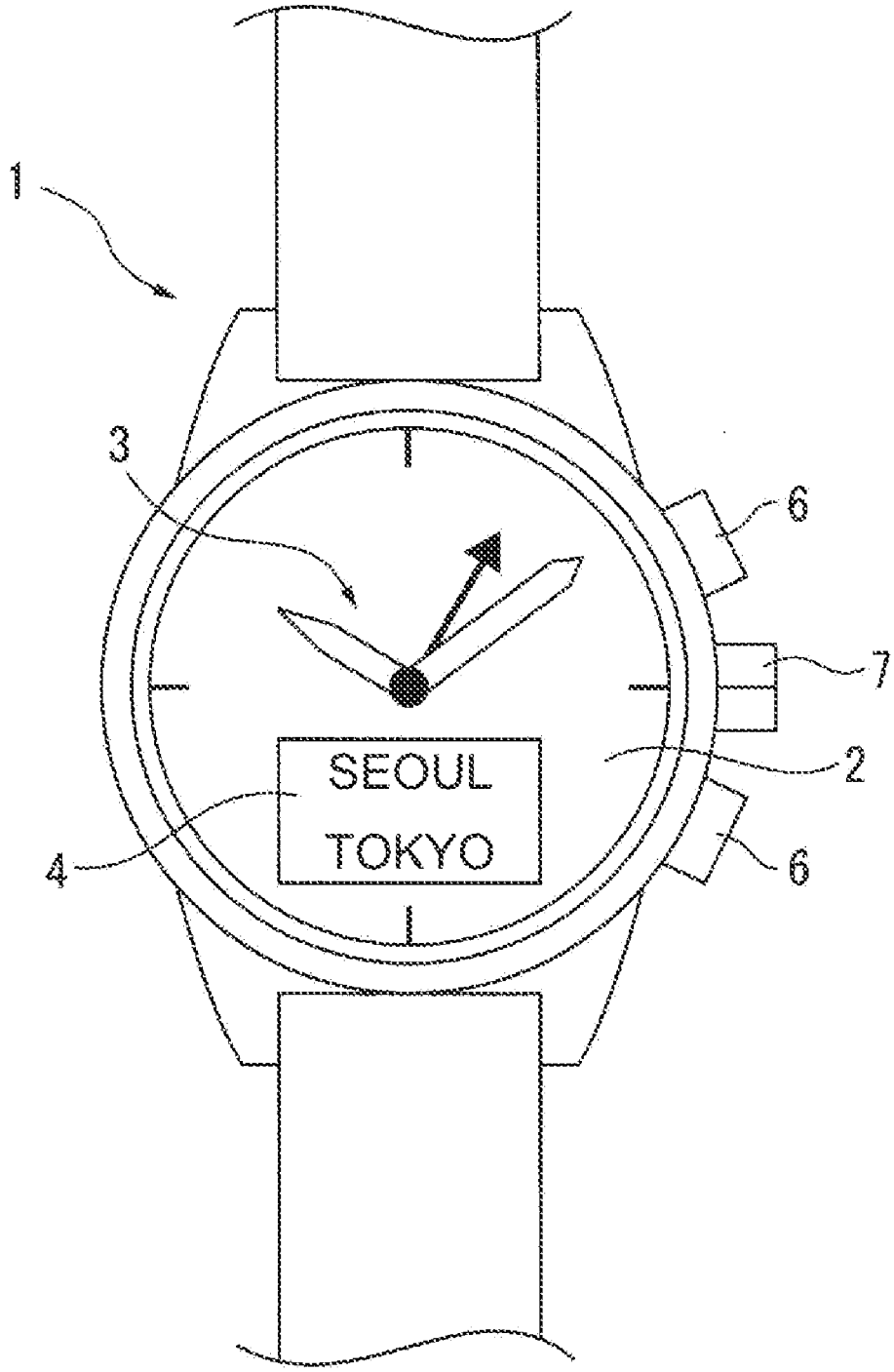
FIG. 8 shows a GPS wristwatch according to the first embodiment of the invention.

The time zone display 23 then displays the time zone candidate city names Seoul and Tokyo acquired by the time zone acquisition component 22 in the display 4 as shown in FIG. 8 (S15).

The time zone selection component 24 then executes the selection process (S16) whereby the time zone candidates (city names) are displayed on the display 4 for selection by the user. More specifically, the time zone selection component 24 displays the list of time zone candidate city names on the display 4 with the first city name highlighted to indicate the current selection.

When the user then presses one of the buttons 6, the time zone selection component 24 highlights the next selected city name, enabling the user to cycle sequentially through the list.

When the time zone selection component 24 presses the other button 6, the currently highlighted city name is confirmed as the selected city.

The time zone candidate city name selection process is thus executed by the user (S16). If the user is at Narita Airport, for example, and SEOUL is highlighted on the display, the user changes the selected city name to TOKYO and then confirms the selection of TOKYO as a city in the current time zone.

The time calculation component 25 then gets the time difference information for the time zone candidate (city name in a candidate time zone) selected by the time zone selection component 24 from the time zone data table 36, and sets this time difference in the time difference storage area in RAM 31 (S17). The time calculation component 25 then adds the UTC offset and the time difference to the received GPS time to get the local time. More specifically, the UTC (Coordinated Universal Time) is acquired by correcting the GPS time with the UTC offset, and the local time is calculated by adding the time difference from UTC to the UTC.

For example, if Tokyo is selected from the time zone candidate list, the time difference to UTC is +9 hours. The time calculation component 25 therefore sets +9 as the time difference to UTC, and if the UTC acquired by adding the UTC offset to the GPS time is 1:10, for example, calculates the local time in Tokyo to be 10:10 by adding 9 hours to the UTC.

As described above, the time difference setting is stored in RAM 31. As a result, when only the time information is later received from a GPS satellite 5, the time calculation component 25 calculates the current time (local time) by simply adding the time difference stored in RAM 31 to the UTC acquired from the satellite.

The time display 26 then displays the time calculated by the time calculation component 25, that is, the current time reflecting the time difference to the GPS time (S18).

More specifically, the time display 26 drives a stepping motor to move the hands 3 to the positions indicating the calculated time. The calculated time and the selected city name, for example, are also displayed on the display 4.

This completes the reception process that adjusts the displayed time to the current local time.

Effect of the First Embodiment

The effect of this embodiment of the invention is described next.

The GPS wristwatch 1 receives satellite signals from the GPS satellites 5 and acquires the positioning information for the GPS wristwatch 1, and then extracts and displays the city names of time zone candidates from the region data table 35 and time zone data table 36 based on the positioning information.

As a result, the user can simply select from a list of time zone candidate city names that has been reduced based on the current position information. Compared with when the city names of the candidate time zones are displayed in a fixed sequence from Honolulu to Wellington, for example, the method of the invention enables easily selecting the desired city name and improves user convenience as a result of reducing the number of candidates from which a selection can be made.

Furthermore, because the region data table 35 sets geographically predefined regions and stores the names of cities in the time zones contained in those predefined regions instead of defining the regions based on the time zones, the amount of data to be stored can be greatly reduced compared with methods that store border definitions for each time zone. The method of the invention can thus be desirably used even in devices that do not have enough memory to store time zone border data.

Furthermore, when the time zone is set for a fixed point closest to the current position of a mobile device using the method of the related art, the time zone is determined based on circular areas centered on the selected fixed point, that is, an area is set for each time zone. In areas where the time zones overlap, the chance of detection errors is high when the mobile device moves between fixed points, and preventing such detection errors is difficult.

However, by enabling the user to select from an extracted list of cities in the time zone candidates, the method of the invention can reliably set the time difference for the city (time zone) selected by the user, and thus further improves user convenience.

In addition, the invention defines the regions using a rectangular grid of longitude lines 371 and latitude lines 372. Each region can therefore be defined in the region data table 35 by registering the coordinates of only two diagonally opposite corners for each rectangle, and the amount of data in the region data table 35 can therefore be reduced.

Furthermore, because the size of each region can be freely controlled, regions where the time zones are large, such as in North America and South America, can be appropriately sized to reduce the number of regions stored in the region data table 35 and further reduce the amount of data accordingly.

Furthermore, because the regions are rectangular areas defined by longitude lines 371 and latitude lines 372, a simple process can be used to determine the region in which the acquired positioning information is located. The region can therefore be determined more quickly than in a configuration that must determine the distance between the positioning coordinates of a mobile device and the positioning coordinates of multiple fixed points.

Embodiment 2

A second embodiment of the invention is described next with reference to FIG. 9 and FIG. 10. In this second and further embodiments described below, parts that are substantially identical to parts in other embodiments are identified by the same reference numerals and further description thereof is omitted.

Figures 10A, 10B:
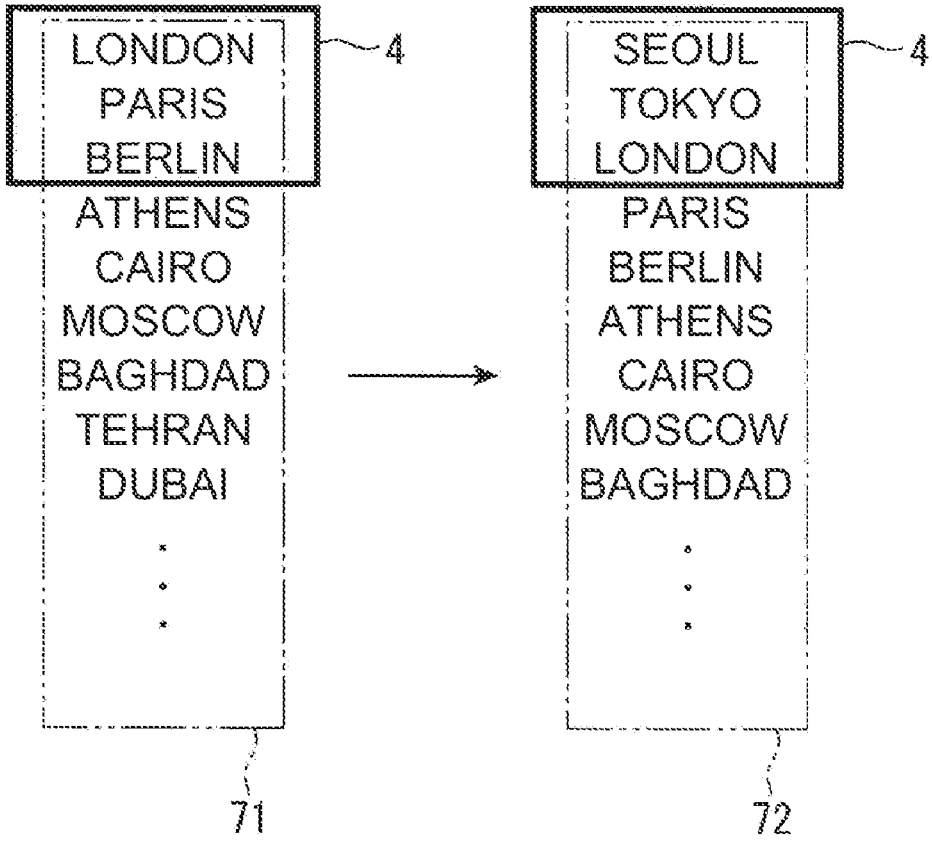
FIG. 10 shows an example of time zone lists in the second embodiment of the invention.

As shown in FIG. 10, the second embodiment of the invention moves the city names of the extracted time zone candidates to the top of the list displayed on the display 4 while enabling selection of other city names.

The hardware configuration of the GPS wristwatch 1 in this second embodiment of the invention is the same as the first embodiment shown in FIG. 2 and FIG. 6, and further description thereof is omitted.

Figure 9:
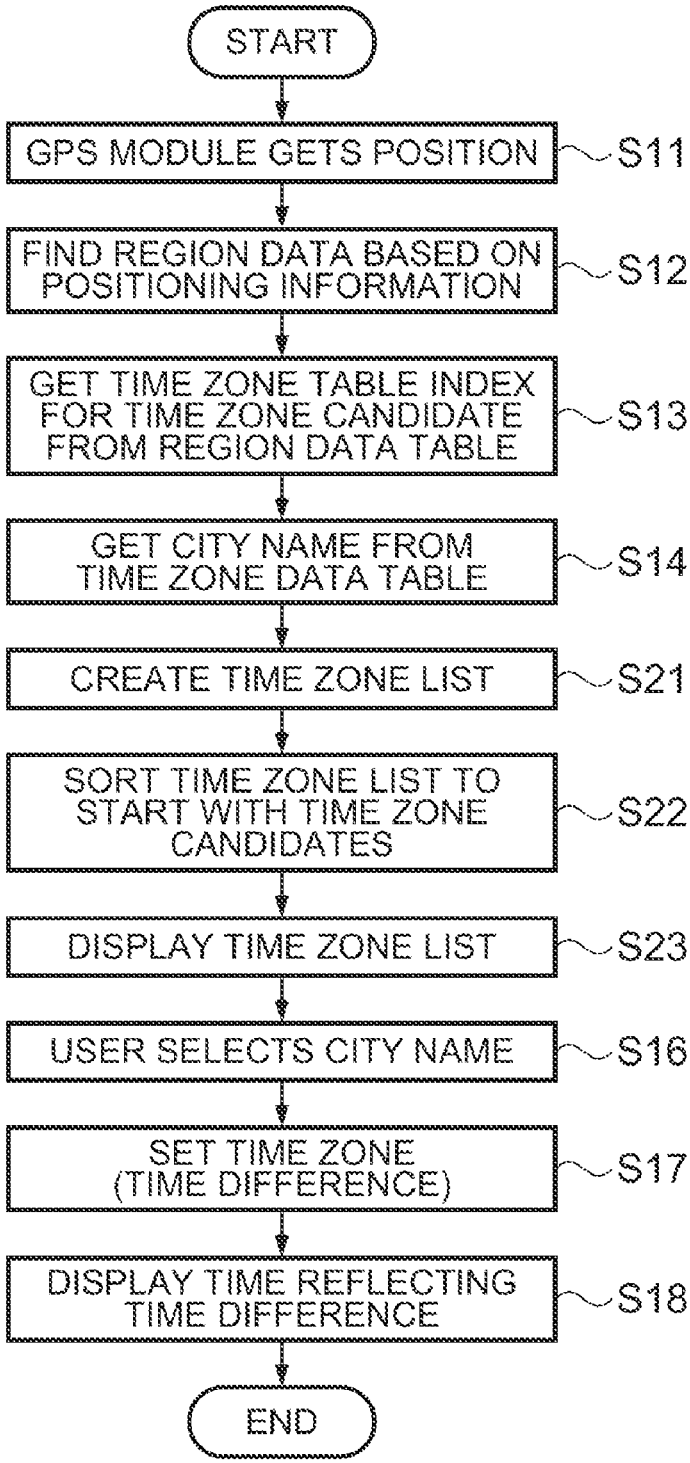
FIG. 9 is a flow chart describing the reception process in a second embodiment of the invention.

The second embodiment runs the reception process shown in the flow chart in FIG. 9. Note that steps identical to those in the flow chart of the first embodiment described above are identified by the same reference numerals in the flow chart in FIG. 9, and further description thereof is omitted.

More specifically, when the reception process starts the reception controller 21 of the control device 20 drives the GPS device 10 (GPS module) to get the positioning information (S11).

The time zone acquisition component 22 then searches the region data table 35 based on the acquired positioning information, and detects the region in which the positioning information (coordinate data) is located (S12).

The time zone acquisition component 22 then gets the time zone table index from the time zone table index 352 field for the detected region in the region data table 35 (S13).

The time zone acquisition component 22 then gets the city names for the acquired time zone table index from the time zone data table 36 (S14).

The time zone display 23 then compiles a list of time zone candidate city names, that is, a time zone list 71, based on the time zone data table 36 as shown in FIG. 10 (A) (S21). More specifically, the time zone display 23 creates a list of city names in order of the time difference from London, where the time difference to UTC is 0. In this example a list is created with Paris and Berlin at a time difference of +1 following London and followed by Athens and Cairo at a time difference of +2 and so forth.

The time zone display 23 then resorts the list to start with the time zone candidates acquired by the time zone acquisition component 22 at the beginning of the city name list (S22). For example, if the time zone candidate city names acquired by the time zone acquisition component 22 are Seoul and Tokyo, Seoul and Tokyo are moved to the beginning of the list as shown in FIG. 10 (B) followed by London and the remaining time zone list to create a new time zone list 72.

The time zone display 23 then displays this resorted time zone list 72 on the display 4 (S23). While the number of items that can be displayed depends upon the size of the display 4, this embodiment of the invention displays three city names at a time and displays other city names on the display 4 by scrolling sequentially through the list using the buttons 6 and crown 7.

The time zone selection component 24 then executes the selection process (S16) for selecting the city name of a time zone candidate displayed on the display 4 based on user operations.

The time calculation component 25 then gets the time difference information for the time zone candidate selected by the time zone selection component 24 from the time zone data table 36, and sets this time difference in RAM 31 (S17).

The time display 26 then displays the time calculated by the time calculation component 25, that is, the current time reflecting the time difference to the GPS time (S18).

Effect of the Second Embodiment

The second embodiment of the invention has the same effect as the first embodiment described above.

In addition, because the time zone display 23 creates and displays on the display 4 a time zone list 72 that starts with the city names representing the time zones in the region containing the acquired positioning information and continues with other cities representing other time zones, the user can easily select a city (time zone) corresponding to the current location or a city in some other time zone. This enables the user to set the time to the local time at the intended destination before travelling to a foreign country, for example, and thus further improves user convenience.

Embodiment 3

A third embodiment of the invention is described next with reference to FIG. 11 and FIG. 12.

This third embodiment of the invention differs from the second embodiment in that when there are plural time zone candidates extracted based on the positioning information and there is a record of a previous selection, the previously selected city name is moved to the beginning of the list. Other aspects of this embodiment are the same as in the second embodiment, and further description thereof is omitted or simplified.

The hardware configuration of the GPS wristwatch 1 in this third embodiment of the invention is the same as the first embodiment shown in FIG. 2 and FIG. 6, and further description thereof is omitted.

Figure 11:
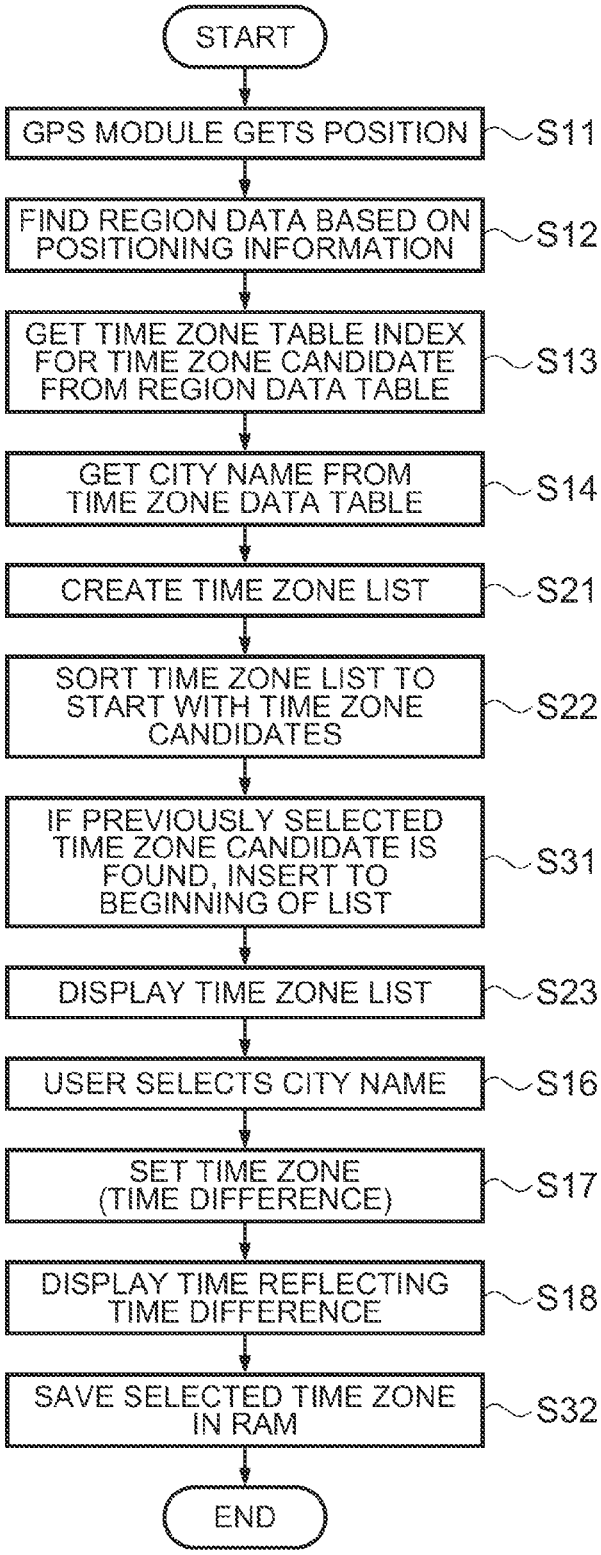
FIG. 11 is a flow chart describing the reception process in a third embodiment of the invention.

The third embodiment runs the reception process shown in the flow chart in FIG. 11. Note that steps identical to those in the flow chart of the second embodiment described above are identified by the same reference numerals in the flow chart in FIG. 11, and further description thereof is omitted.

More specifically, when the reception process starts the reception controller 21 of the control device 20 drives the GPS device 10 (GPS module) to get the positioning information (S11).

The time zone acquisition component 22 then searches the region data table 35 based on the acquired positioning information, and detects the region in which the positioning information (coordinate data) is located (S12).

The time zone acquisition component 22 then gets the time zone table index from the time zone table index 352 field for the detected region in the region data table 35 (S13).

The time zone acquisition component 22 then gets the city names for the acquired time zone table index from the time zone data table 36 (S14).

Figures 12A, 12B, 12C:
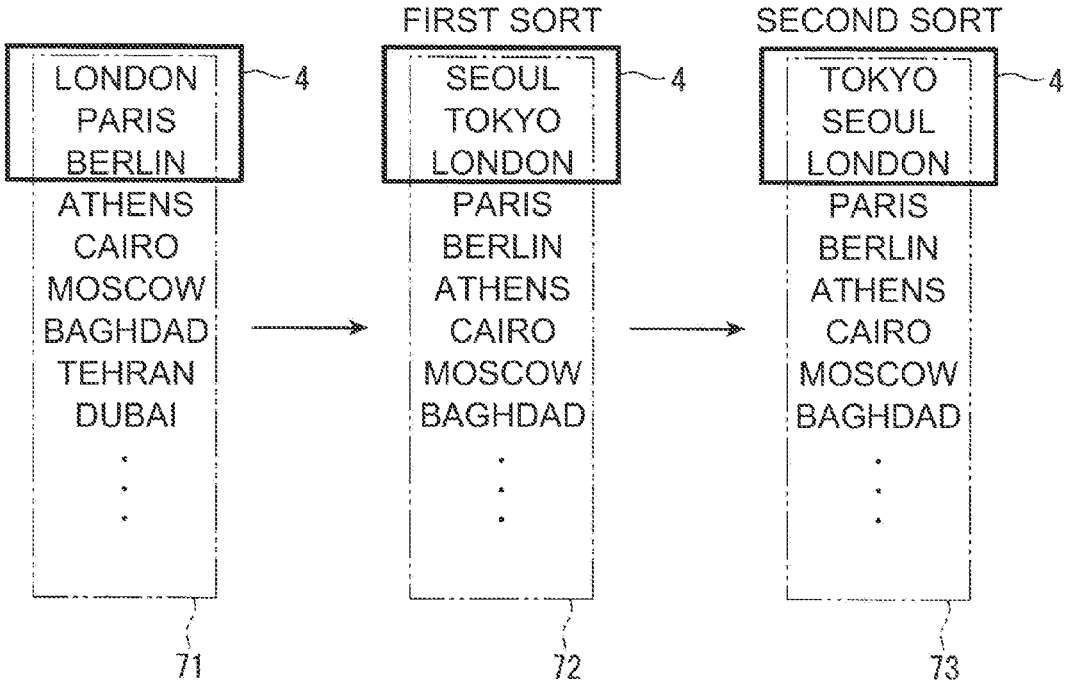
FIG. 12 shows an example of time zone lists in the third embodiment of the invention.

The time zone display 23 then compiles a list of time zone candidate city names, that is, a time zone list 71, based on the time zone data table 36 as shown in FIG. 12 (A) (S21).

The time zone display 23 then resorts the list to start with the time zone candidates acquired by the time zone acquisition component 22 at the beginning of the city name list (S22). For example, if the time zone candidate city names acquired by the time zone acquisition component 22 are Seoul and Tokyo, Seoul and Tokyo are moved to the beginning of the list as shown in FIG. 12 (B) followed by London and the remaining time zone list to create a new time zone list 72.

If there is a record of a previously selected time zone candidate among the time zone candidates for the detected region, the time zone display 23 also moves the previously selected candidate to the top of the list to create another time zone list 73 (S31).

More specifically, if a time zone table index number is stored in the previously selected time zone 353 field of the time zone candidates extracted based on the positioning information, the time zone display 23 moves the city name identified by that time zone table index to the top of the list to create the time zone list 73.

The time zone display 23 thus displays the time zone list 72 shown in FIG. 12 (B) on the display 4 the first time a city name is to be selected (S23).

However, if TOKYO was previously selected, a time zone list 73 having TOKYO moved to the top of the list as shown in FIG. 12 (C) is displayed on the display 4 (S23).

The time zone selection component 24 then executes the selection process (S16) for selecting the city name of a time zone candidate displayed on the display 4 based on user operations.

The time calculation component 25 then gets the time difference information for the time zone candidate selected by the time zone selection component 24 from the time zone data table 36, and sets this time difference in RAM 31 (S17).

The time display 26 then displays the time calculated by the time calculation component 25, that is, the current time reflecting the time difference to the GPS time, on the display device 50(S18).

The time zone selection component 24 then stores the selected time zone information in RAM 31 so that the previous selection can be determined the next time the process runs (S32).

Effect of the Second Embodiment

The second embodiment of the invention has the same effect as the second embodiment described above.

By moving the name of a previously selected candidate city to the top of the list, the time zone display 23 makes selecting a city name (time zone) corresponding to the current position even easier. More specifically, when there are plural time zone candidates (city names) for one region and that region is selected, one of the cities must be selected. Because there is a strong possibility that the same city name will be selected again, the user can simply confirm the selection if the previously selected city is displayed at the top of the list, and the selection process is therefore simplified.

Embodiment 4

Figure 13:
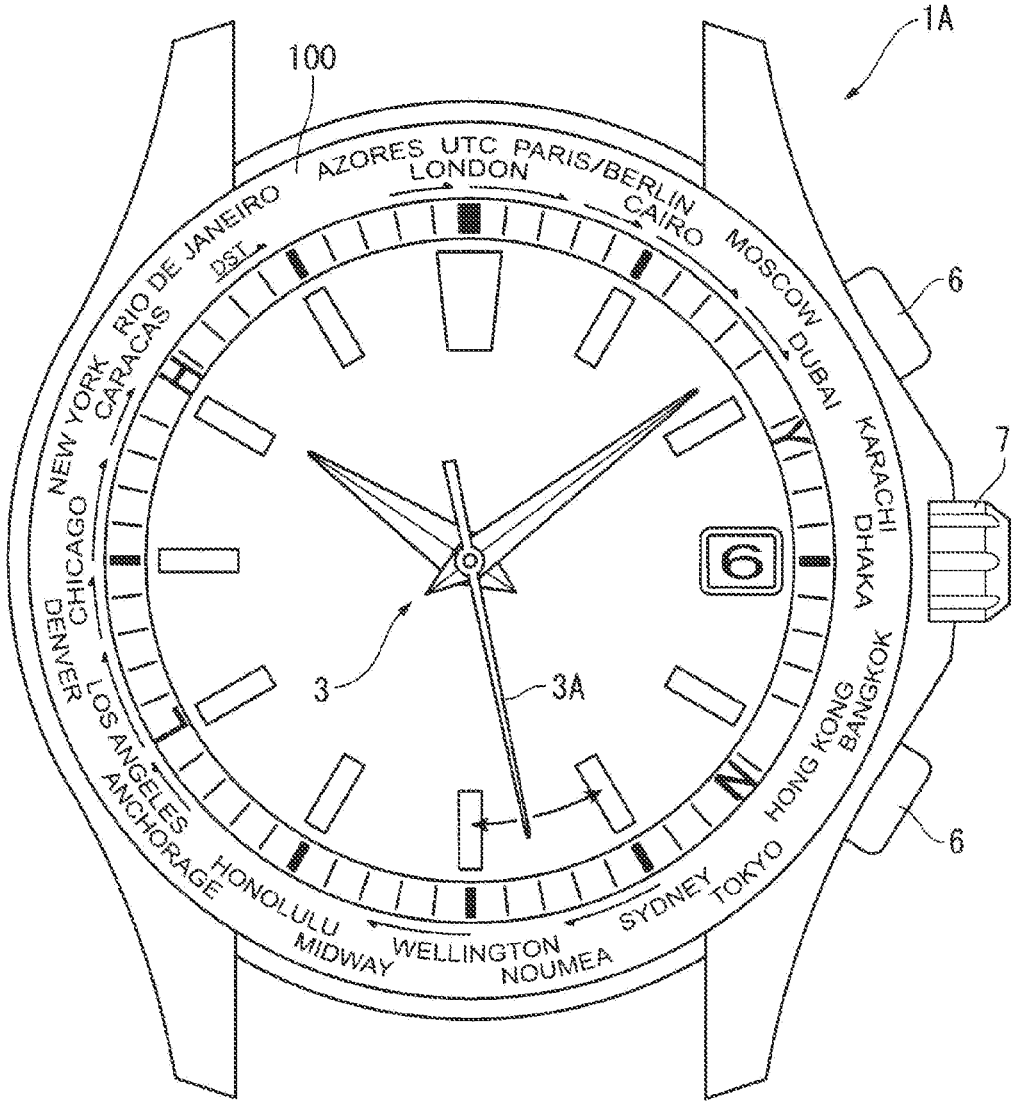
FIG. 13 shows a GPS wristwatch according to a fourth embodiment of the invention.

A fourth embodiment of the invention is described next with reference to FIG. 13 and FIG. 14.

The embodiments described above are combination timepieces 1 having both hands 3 and a digital display device such as the display 4. This fourth embodiment of the invention relates also to an analog timepiece 1A that has only hands 3 as shown in FIG. 13.

Note that the hardware configuration of the GPS wristwatch 1A in this fourth embodiment of the invention is the same as the first embodiment shown in FIG. 2 and FIG. 6, and further description thereof is omitted.

The GPS wristwatch 1A according to this fourth embodiment of the invention displays the city names that are the time zone candidates on a bezel 100. Time zones that use daylight savings time or summer time are additionally indicated by accompanying arrows for easy recognition.

The current time zone setting is further indicated by the second hand 3A of the GPS wristwatch 1A pointing to the appropriate city name on the bezel 100.

Figure 14:
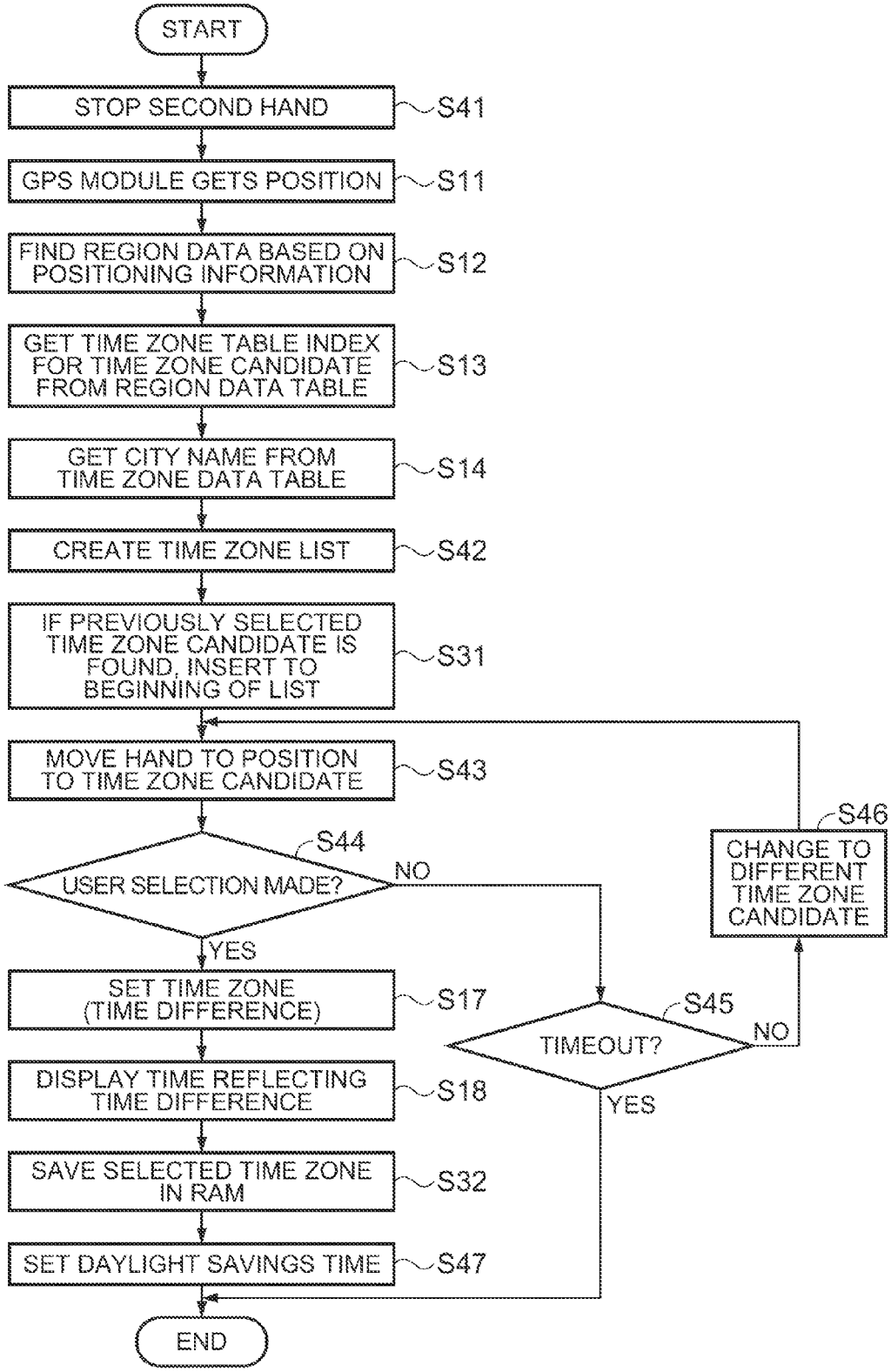
FIG. 14 is a flow chart describing the reception process in the fourth embodiment of the invention.

The fourth embodiment runs the reception process shown in the flow chart in FIG. 14. Note that steps identical to those in the flow chart of the third embodiment described above are identified by the same reference numerals in the flow chart in FIG. 14, and further description thereof is omitted.

When this reception process starts, the control device 20 first stops the second hand 3A (S41).

The reception controller 21 of the control device 20 then drives the GPS device 10 (GPS module) to get the positioning information (S11).

Next, the time zone acquisition component 22 searches the region data table 35 based on the acquired positioning information, and detects the region in which the positioning information (coordinate data) is located (S12).

The time zone acquisition component 22 then gets the time zone table index from the time zone table index 352 field for the detected region in the region data table 35 (S13).

The time zone acquisition component 22 then gets the city names for the acquired time zone table index from the time zone data table 36 (S14).

The time zone display 23 then compiles a list of time zone candidate city names, that is, a time zone list 71, based on the time zone data table 36 (S42). The time zone list contains only the city names identified from the acquired time zone table indices, and is therefore normally a list of only two to four city names.

If there is a record of a previously selected time zone candidate among the time zone candidates for the detected region, the time zone display 23 moves the previously selected candidate to the top of the time zone list (S31).

The time zone display 23 then moves the second hand 3A to the position indicating the first candidate in the time zone candidate list (S43). For example, if the time zone candidate list based on the acquired positioning information has two city names, SYDNEY (a time difference of +10 hours) and WELLINGTON (a time difference of +12 hours), the time zone display 23 moves the second hand 3A to the position of SYDNEY at the beginning of the list, that is, the 5 o'clock marker, and holds the second hand 3A at this position for a predetermined time (such as 3 seconds).

The time zone selection component 24 then detects if the user has operated the button 6 to change the selection while the second hand 3A is stopped (S44).

If the user does not make a selection, the time zone display 23 detects if a timeout has occurred by detecting if a predetermined time (such as 30 seconds) has passed since the second hand 3A was stopped in step S41 (S45).

If a timeout is not detected in S45, the time zone selection component 24 changes the time zone candidate to a different candidate (S46). In this example the time zone selection component 24 changes the time zone candidate to the next candidate in the list, Wellington.

When the time zone candidate changes the time zone selection component 24 moves the second hand 3A to the position indicating the new time zone candidate, Wellington (S43). More specifically, the second hand 3A is moved from the 5 marker denoting Sydney to the 6 marker denoting Wellington, and then stops for a predetermined time.

If the user does not make a selection in S44, the time zone display 23 repeats steps S43 to S46 until a timeout is detected in S45. As a result, if the list of time zone candidates is two cities, such as Sydney and Wellington in this example, the second hand 3A moves back and forth at a regular interval between the corresponding markers while stopping at the marker denoting each candidate for a predetermined time. The second hand 3A thus moves back and forth in a wiper action similar to the windshield wiper of an automobile.

If the list of time zone candidates is three cities, the second hand 3A moves at a regular interval between the corresponding markers while stopping at the marker denoting each candidate for a predetermined time. In this case the time zone display 23 may move the second hand 3A bidirectionally as described above, or it may move the second hand 3A in only one direction, such as clockwise. However, because the cities are set at relatively close markers, the time zone display 23 preferably moves the second hand 3A back and forth in a wiper action as described above.

If the user makes a selection in S44, the time calculation component 25 then gets the time difference information for the time zone candidate selected by the time zone selection component 24 from the time zone data table 36, and sets this time difference in RAM 31 (S17).

The time display 26 then displays the time calculated by the time calculation component 25, that is, the current time reflecting the time difference to the GPS time, on the display device 50 (S18).

The time zone selection component 24 then stores the selected time zone information in RAM 31 so that the previous selection can be determined the next time the process runs (S32).

The time zone selection component 24 then runs a daylight savings time adjustment process (S47). If daylight savings time is not used in the time zone represented by the selected city, the process may end without executing the daylight savings time adjustment process (S47).

In the daylight savings time adjustment process (S47) the time zone selection component 24 moves the second hand 3A to the 0 position, and then moves the second hand 3A back and forth between the 0 and 1 in the wiper action described above.

The user presses the button 6 when the second hand 3A is stopped at the 0 if daylight savings time does not currently apply, and presses the button 6 when the second hand 3A is stopped at the 1 if daylight savings time applies. The time zone selection component 24 controls whether to set the time for daylight savings time by detecting the position of the second hand 3A when the button 6 is pressed. If daylight savings time is set, the time calculation component 25 resets the time for daylight savings time by adjusting the time difference setting +1 hour, for example. The time displayed by the time display 26 can thus be set to account for daylight savings time.

Effect of the Fourth Embodiment

The fourth embodiment of the invention has the same effect as the embodiments described above.

In addition, because the time zone (time difference) is set using the second hand 3A and button 6, the correct time zone (time difference) can be set in an analog timepiece that does not have a display 4 for digitally displaying the city names.

Furthermore, the time difference (time zone) can be set by moving the second hand 3A back and forth between the markers denoting the extracted city names, and pressing the button 6 when the second hand 3A is stopped at the marker denoting the city name to be selected. Operation is thus simplified for the user, there is no need to add special parts for incorporation in a conventional analog timepiece, utility is excellent because it is only necessary to add a program for controlling the second hand 3A and button 6, and the invention can thus be widely applied in GPS wristwatches 1A.

Furthermore, because the process ends if a timeout is detected in step S45, the movement is prevented from continuously consuming power if the user does not press the selection button.

Furthermore, because the second hand 3A is also used to set daylight savings time in addition to the time zone, this aspect of the invention affords a particularly user-friendly GPS wristwatch 1A.

Variations

The invention is not limited to the embodiments of the invention described above.

For example, the regions into which geographical information is divided are rectangular in the embodiments described above, but the invention is not limited to rectangular regions and other shapes may be used, including triangular, trapezoidal, or polygons with protruding or recessed portions. However, rectangular regions are beneficial because they can be defined using the coordinates for only two points, and can be easily compared with the received positioning information.

The regions are also defined by longitude lines 371 and latitude lines 372 in the foregoing embodiments, but shapes not defined by longitude lines 371 or longitude lines 371 may be used instead. For example, rectangular regions enclosed by lines inclined 45 degrees to the longitude lines 371 and latitude lines 372 may be used.

In addition, when the regions are defined so that the number of time zones contained in each region is less than or equal to a predetermined setting, a setting of 6 is used in the foregoing embodiments, but this setting may be in the range 1-5 to define smaller regions containing fewer time zones. On the other hand, the number of time zones may be set to 7 or more to increase the size of the regions to include 7 or more time zones. However, the time zone selection operation becomes increasingly cumbersome if the regions are enlarged so that the number of time zones is increased. On the other hand, the amount of data to store increases if the area size is reduced and the number of areas increases. The region size is therefore preferably set with consideration for ease of selection (operability) and the usable memory capacity.

City names are displayed as the time zone candidates in the embodiments described above, but country names may be displayed instead of city names, for example. Further alternatively, the actual time difference may be displayed numerically.

The first to third embodiments described above relate to a combination timepiece, but may also be applied to a digital timepiece that does not have hands.

The electronic timepiece according to the present invention described above is also not limited to wristwatches, and can be widely applied to pocket watches and other portable electronic timepieces that are used mobilely.

The invention is also not limited to electronic timepieces as described above, and can be used with various other types of electronic devices with other functions in addition to a timekeeping function. The invention may, for example, be used with cell phones that have a GPS function and a timepiece function, navigation devices, and other electronic devices.

The foregoing embodiments are described with reference to a GPS satellite, but the invention is not limited to GPS satellites and can be used with Global Navigation Satellite Systems (GNSS) such as Galileo and GLONASS, and other positioning information satellites that transmit satellite signals containing time information, including the SBAS and other geostationary or quasi-zenith satellites.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. An electronic timepiece, comprising:

a reception unit that can receive satellite signals transmitted from positioning information satellites and acquire time information and positioning information;

a time zone data storage component that stores region data dividing geographical information for which time zone information is set into a plurality of regions, and time zone information for each region;

a time zone information acquisition component that extracts a region containing positioning information acquired by the reception unit from the region data, and acquires the time zone information for that region;

a time zone information display that displays the time zone information acquired by the time zone information acquisition component as time zone candidates;

a user operated input device;

a time zone information selection component that selects time zone information from the time zone candidates displayed on the time zone information display based on operation of the user operated input device;

a time calculation component that calculates the current time based on the time information acquired by the reception unit and the time zone information selected by the time zone information selection component; and a time display that displays the current time.

2. The electronic timepiece described in claim 1, wherein each region in the region data is sized so that each region contains less than or equal to a predetermined number of time zones.

3. The electronic timepiece described in claim 1, wherein each region in the region data is a rectangular region.

4. The electronic timepiece described in claim 1, further comprising:

a time zone information selection storage component that stores the time zone information selected by the time zone information selection component;

wherein the time zone information display displays the previously selected time zone as the first time zone candidate when a previously selected time zone is stored in the time zone information selection storage component for the region containing the positioning information received by the reception unit.

5. The electronic timepiece described in claim 1, further comprising:

a digital display device for displaying information;

wherein the time zone information display displays the time zone candidates acquired by the time zone information acquisition component on the digital display device; and the time zone information selection component selects a time zone candidate displayed on the digital display device based on operation of the input device.

6. The electronic timepiece described in claim 5, wherein the time zone information display displays the time zone candidate acquired by the time zone information acquisition component first on the digital display device, and can display other time zone candidates following the time zone information.

7. The electronic timepiece described in claim 1, further comprising:

an analog display device including a hand and a dial with markings indicating time zone candidates;

wherein the time zone information display moves the hand at a regular time interval to sequentially point to markings indicating time zone candidates acquired by the time zone information acquisition component; and the time zone information selection component selects the time zone candidate indicated by the hand when the input device is operated.

8. A time adjustment method for an electronic timepiece, comprising:

storing region data dividing geographical information for which time zone information is set into a plurality of regions, and time zone information for each region;

receiving satellite signals transmitted from positioning information satellites and acquiring time information and positioning information;

extracting a region containing positioning information acquired by the reception step from the region data, and acquires the time zone information for that region;

displaying the time zone information acquired by the time zone information acquisition step as time zone candidates;

selecting time zone information from the displayed time zone candidates based on operation of a user operated input device;

calculating the current time based on the time information acquired by the reception step and the time zone information selected by the time zone information selection step; and displaying the current time.

9. A control program for an electronic timepiece comprising a reception unit that can receive satellite signals transmitted from positioning information satellites and acquire time information and positioning information, a control device, a storage device that stores region data dividing geographical information for which time zone information is set into a plurality of regions, and time zone information for each region, a user operated input device, and a display device, wherein the control program, when executed, causes the control device to:

extract a region containing positioning information acquired by the reception unit from the region data and acquire the time zone information for that region;

display the acquired time zone information as time zone candidates;

select time zone information from the displayed time zone candidates based on operation of the user operated input device;

calculate the current time based on the time information acquired by the reception unit and the selected time zone information; and display the current time.

* * * * *